US005127462A

United States Patent [19]

Moriwaki et al.

[11] Patent Number: 5,127,462

[45] Date of Patent: Jul. 7, 1992

[54] SIDE WALL CONSTRUCTION FOR CONTINUOUS BELT CASTER

[75] Inventors: Saburo Moriwaki; Hitoshi Osugi; Masayuki Onishi; Takao Koshikawa; Nagayasu Bessho; Keiichiro Isomura; Takeshi Higashihara, all of Chiba; Tomoaki Kimura, Ibaraki, all of Japan

[73] Assignee: Kawasaki Steel Corporation, Japan

[21] Appl. No.: 704,895

[22] Filed: May 21, 1991

Related U.S. Application Data

[63] Continuation of Ser. No. 370,343, Jun. 22, 1989, abandoned.

[30] Foreign Application Priority Data

Jun. 24, 1988 [JP] Japan ..... 63-155046
Nov. 28, 1988 [JP] Japan ..... 63-298046

[51] Int. Cl.[5] ..... B22D 11/06
[52] U.S. Cl. ..... 164/432; 164/481
[58] Field of Search ..... 164/428, 432, 480, 481

[56] References Cited

FOREIGN PATENT DOCUMENTS 58-38640 3/1983 Japan ..... 164/432
63-43744 2/1988 Japan ..... 164/481
63-149044 6/1988 Japan ..... 164/432

*Primary Examiner*—Kuang Y. Lin
*Attorney, Agent, or Firm*—Austin R. Miller

[57] ABSTRACT

A side wall construction for a continuous belt caster includes a metallic side wall body and a refractory layer attached on the central portion of the side wall body. The metallic side wall body has side edge portion extending substantially in flush with the the surface of the refractory layer. The refractory layer is formed with a center projection of essentially triangular cross-section. The height of the peak of the projection is gradually decreased toward downstream of transfer direction of the liquidus and solidus metal. On the other hand, it may be possible to formulate the refractory layer as double layer construction of a heat insulating refractory layer and a wear-resistantive refractory layer.

22 Claims, 5 Drawing Sheets

SIDE WALL CONSTRUCTION FOR CONTINUOUS BELT CASTER

This application is a continuation of application Ser. No. 07/370,343, filed Jun. 22, 1989 now abandoned.

BACKGROUND OF THE INVENTION

1. Field of the Invention

The present invention relates generally to a continuous belt caster for casting thin cast block. More specifically, the invention relates to a side wall construction of a continuous belt caster.

2. Description of the Background Art

In recent years, various continuous belt casters have been developed and proposed for effectively casting relatively thin and continuous cast blocks. One of such continuous belt caster is a synchronous belt caster which defines a funnel-like path having a wider inlet and a narrower outlet so as to form solidified shell during travel therethrough. In general, such a synchronous belt caster has a pair of endless belts forming a moving wall of the caster and a pair of stationary side walls for defining the aforementioned funnel-like path. Each of the side walls has a wider transverse width at the portion in the vicinity of the inlet and a narrower transverse width at the portion in the vicinity of the outlet so as to define the funnel-like path gradually narrowing the path area toward the outlet.

Molten metal, such as molten pig iron or molten steel, is supplied to such belt caster through the inlet and cooled by transferring heat between the belts for gradually forming and gradually growing a solidified shell in the caster. The cast block is fed out or withdrawn through the outlet. During this process, the thickness of the solidified shell is reduced at a predetermined reduction rate by an essentially funnel shaped path. In such continuous casting process, it is desirable to maintain the melt in the vicinity of the side wall in a liquidus state. For this purpose, Japanese Patent First (unexamined) Publication Tokkai) Showa 58-218360 proposes a side wall construction provided with a refractory at the transverse center thereof. In the proposed construction, the refractory is supported on a metallic side wall body. The side wall body has positions extending along the side edge of the refractory and establishes tight contact with the endless belt.

Despite the presence of the refractory, it is still difficult to provide satisfactory delay of solidification. Namely, when the temperature of the melt is relatively low or when the speed of the melt flowing though the path is relatively low, substantial heat exchange is caused between the melt and the refractory for causing growth of the solidified shell on the refractory. On such an occasion, the solidified shell grown on the refractory is drawn together with the shells grown on the belt or the metallic edge portion of the side wall. If the stiffness of the solidified shell on the refractory is relatively low, it will still be possible to compress the shell during travel through the path toward the outlet. However, if the stiffness of the shell is substantial in such an extent that can resist against compression force exerted by the walls of the caster, since the solidified shell forms a wedge shaped block, metal penetration can be caused. If metal penetration occurs, movement of the solidified shell at the portion in the vicinity of the side wall can be completely prevented and movement of the solidified shell at the transverse central portion where the solidifying block mates with the belt is permitted to move. This tends to cause break-out of the cast block. In the alternative, because of excessive thickness of the shell, the belt will be subjected to substantial bending stress to cause damaging of the belt.

As a material to form the refractory layer on the side wall, one of silica, boron nitride, sialon and so forth can be used. Such materials generally have high heat conductivity to cause a greater magnitude of heat transfer between the metal to promote growth of the solidified shell when such material is solely used for forming the refractory layer. In addition, these materials as the refractory have relatively large linear expansion coefficients. Therefore, deformation can be caused in the metallic side wall body when substantial thermal expansion of the refractory is caused. On the other hand, when a material having low heat transfer coefficient, such as molten silica brick, is used for forming the refractory layer on the side wall, a solidified layer can grow not at the metallic side edge portion but also on the refractory layer. The solidified shell on the refractory layer tends to cause wearing of the surface of the refractory layer. Therefore, the refractory layer formed of the material having low heat transfer coefficient would not be applicable for the belt caster for long periods of use.

In order to obtain satisfactory delay in solidification of the melt in the portion in the vicinity of the refractory of the side wall, Japanese Patent First (unexamined) Publication (Tokkai) Showa 58-218326 discloses a technology of positively heating the refractory so as to prevent the melt from solidifying. However, this clearly increases costs and requires satisfactory isolation of electricity used for heating.

SUMMARY OF THE INVENTION

Therefore, it is an object of the present invention to provide a novel and useful side wall construction for a continuous belt caster, which can solve the problems in the background art set forth above.

In order to accomplish the aforementioned and other objects, a side wall construction for a continuous belt caster, according to the present invention, includes a metallic side wall body and a refractory layer attached on the central portion of the side wall body. The metallic side wall body has a side edge portion extending substantially flush with the surface of the refractory layer. The refractory layer is formed with a center projection of essentially triangular cross-section. The height of the peak of the projection is gradually decreased toward the bottom of the side wall body.

On the other hand, it may be possible to formulate the refractory layer as a double layer construction of a heat insulating refractory layer and a wear-resistantive refractory layer.

According to one aspect of the invention, a side wall structure of a continuous caster which has a pair of endless circulating bodies forming moving walls of the caster and a pair of side walls forming stationary walls of the caster, the stationary walls being cooperative with the moving walls for defining a casting chamber to which a molten metal is supplied for casting a continuous cast block, the side wall comprising:

a metallic wall body formed of a metal, a refractory layer provided on the transverse central portion of the metallic wall body having a surface portion interfacing with molten metal for preventing the latter from solidifying thereon, and metallic side edge members integrally formed with the metallic wall body and extending along both transverse edges of the refractory layer to expose surfaces thereof.

According to another aspect of the invention, a side wall structure of a continuous caster which has a pair of endless circulating bodies forming moving walls of the caster and a pair of side walls forming stationary walls of the caster, the stationary walls being cooperative with the moving walls for defining a casting chamber to which a molten metal is supplied for casting a continuous cast block, the side wall comprising:

a metallic wall body formed of a metal, a refractory layer provided on the transverse central portion of the metallic wall body having a surface portion interfacing with molten metal for preventing the latter from solidifying thereon, which solidification preventive surface portion comprises an essentially triangular projection extending transverse to the center and projecting into the casting chamber, metallic side edge members integrally formed with the metallic wall body and extending along both transverse edges of the refractory layer to exposed surfaces thereof.

Preferably, the triangular projection is provided a taper in an axial direction of the casting chamber and the side edge members are also provided with a taper in the axial direction of the casting chamber, tapers of the triangular projection and the side edge members being opposite to each other. Further preferably, the triangular projection has its height decreasing toward downstream.

According to a further aspect of the invention, a side wall structure of a continuous caster which has a pair of endless circulating bodies forming moving walls of the caster and a pair of side walls forming stationary walls of the caster, the stationary walls being cooperative with the moving walls for defining a casting chamber to which a molten metal is supplied for casting a continuous cast block, the side wall comprising:

a metallic wall body formed of a metal, a refractory layer provided on the transverse central portion of the metallic wall body having a surface portion exposed to the casting chamber, and the refractory layer comprising an inner heat insulative refractory layer and an outer wear-resistantive refractory layer which has the surface exposed to the casting chamber, metallic side edge members integrally formed with the metallic wall body and extending along both transverse edges of the refractory layer to expose surfaces thereof.

The side wall structure may further comprise a heat insulative layer formed on the surface of the wear-resistantive refractory layer. The heat insulative layer may be provided in a region below a meniscus of the molten metal. The wear-resistantive refractory layer may be formed of a material having shore hardness at a predetermined high temperature range greater than a shore hardness of cast block immediately after casting.

The material of wear-resistantive refractory layer is selected to have a 15 shore hardness at 1200° C. Preferably the wear-resistantive refractory layer is formed of a material selected among silicon nitride, sialon, alumina, mullite and zirconium boride or composition of any one of these and boron nitride. The heat insulative refractory layer is formed of a material selected among MgO board, $SiO_2$ type board, molten silica brick. The heat insulative layer is formed of a material selected among asbestos fabric, glass fiber fabric or rock wool.

BRIEF DESCRIPTION OF THE DRAWINGS

The present invention will be understood more fully from the detailed description given herebelow and from the accompanying drawings of the preferred embodiments of the invention, which, however, should not be taken to limit the invention to the specific embodiment of embodiments, but are for explanation and understanding only.

In the drawings.

DESCRIPTION OF THE PREFERRED EMBODIMENT

Figure 1:
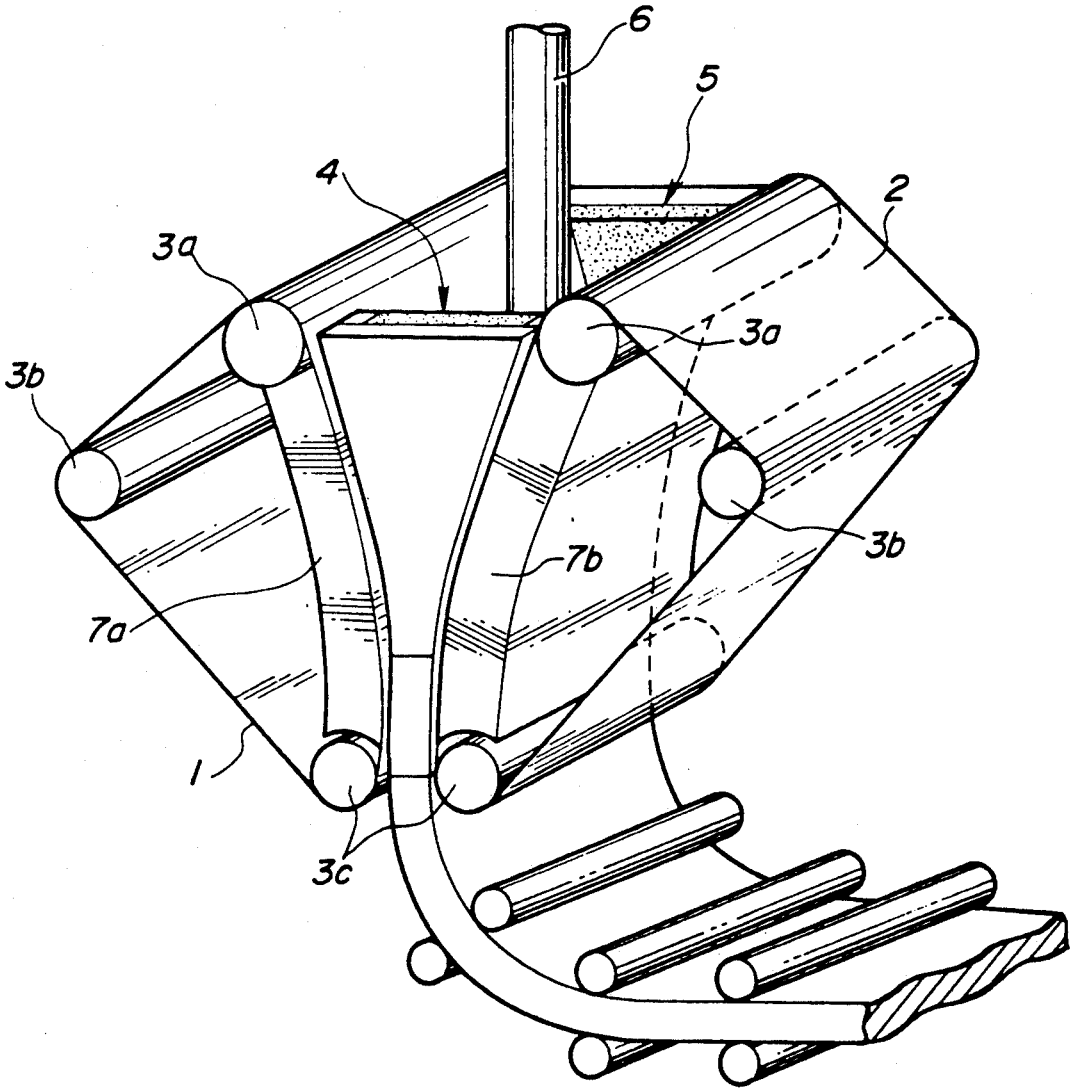
FIG. 1 is a fragmentary perspective illustration of a continuous belt caster, for which a side wall construction according to the present invention is applicable.

Referring now the drawings, particularly to FIG. 1, the general construction of a continuous belt caster, for which a side wall construction, according to the present invention is applicable, will be discussed briefly in order to facilitate better understanding of the invention. As shown in FIG. 1, the belt caster, herewith illustrated, includes a pair of metallic endless belts 1 and 2 forming a moving wall of the caster, and a pair of side walls 4 and 5 forming stationary wall of the caster. Each of the endless belts 1 and 2 is associated with guide rollers 3*a*, 3*b* and 3*c*, one of which is drivingly connected to a driving device (not shown) to be rotatingly driven for circulating the belt. The portion of the belt extending between the guide rollers 3*a* and 3*b* forms the moving wall of the caster and is associated with a cooling pad 7*a* or 7*b*, to which coolant, such as cooling water, is circulated for cooling the associated one of the belt 1 or 2.

As can be seen from FIG. 1, the side walls 4 and 5 are formed into an essentially funnel shape in front elevation to have the greatest width at the top end and gradually reducing the width in the downward direction. The side walls 4 and 5 also have a predetermined length of constant width portion adjacent the lower end thereof. Therefore, the belts 1 and 2 and the side walls 4 and 5 form an essentially wedge-shaped casting chamber. Molten metal, such as molten pig iron or molten steel, is supplied to the casting chamber from the top end inlet from a tundish via a nozzle 6.

Figure 2:
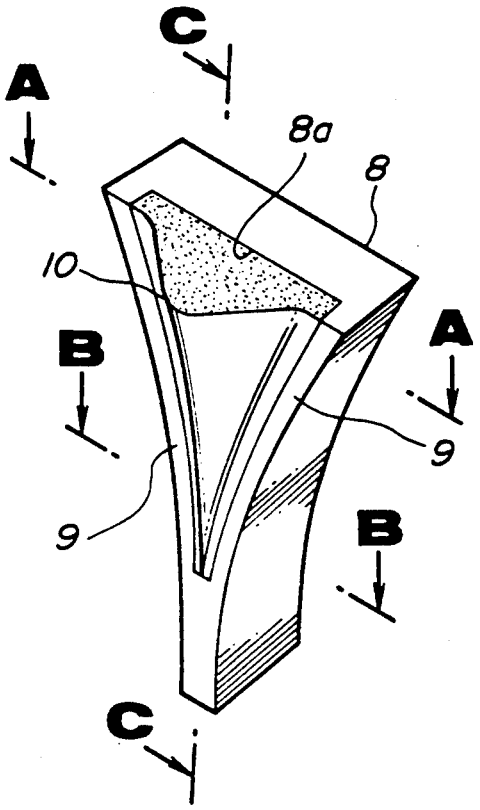
FIG. 2 is a perspective view of the first embodiment of a side wall construction to be employed in the belt caster of FIG. 1.

As seen from FIGS. 1 and 2, the side walls 4 and 5 have metallic wall bodies 8 which are generally formed of a metal. The metal body 8 is formed with an essentially triangular recess 8*a* defined by frame-like side edge portions 9. A refractory layer 10 is disposed within the recess 8*a* to form the side wall assembly.

In the casting chamber, the melt is cooled by heat exchange with the belts 1 and 2 and thus gradually grows a solidified shall on the belts. Also, the portion of the melt interfacing with the side edge portions 9 of the side walls 4 and 5 is also cooled by heat exchanging with the side edge portion and thus grow a solidified shell. The solidified shell growing on the side edge of the side walls 4 and 5 serves for preventing the melt form flowing into a space between the belt and the side wall. During travel in the casting chamber, the melt is thus gradually solidified and withdrawn through the lower end outlet.

Figure 3:
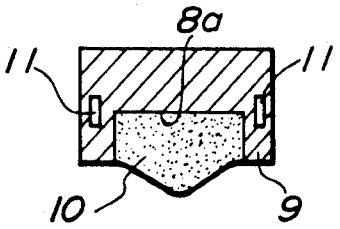
FIGS. 3 and 4 are respectively sections taken along lines A—A and B—B of FIG. 2.
Figure 4:
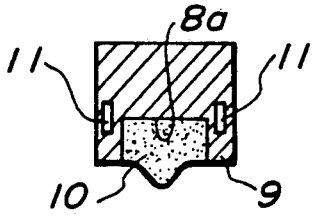

As shown in FIGS. 3 and 4, the wall body 8 of the side wall 4 and 5 is formed with a coolant path 11 for circulating coolant, such as cooling water, for cooling the metallic wall body. As can be seen from FIGS. 3 and 4, the major section of the refractory layer 10 is supported on the recess 8*a*. The refractory layer 10 has an essentially triangular projection 10*a*. The triangular portion 10*a* is oriented at the transverse center of the refractory layer 10 and extends along the casting direction. The height of the peak of the triangular projection 10*a* is the highest at the end adjacent the inlet and is gradually decreased to zero toward downstream end.

Figure 5:
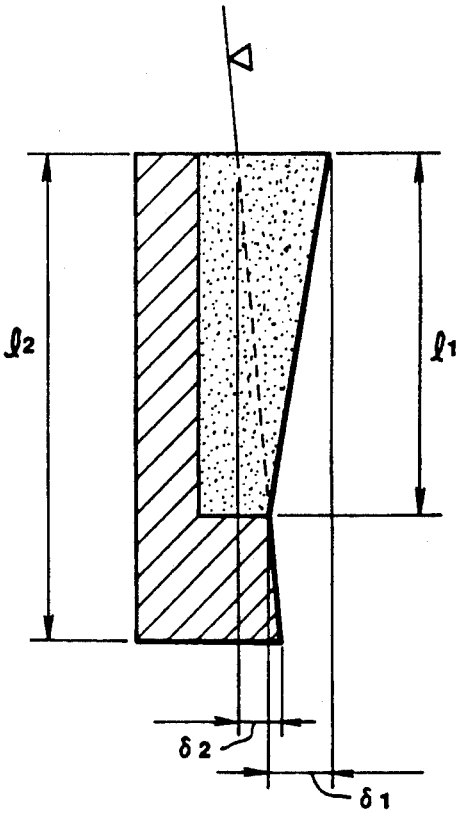
FIG. 5 is a section taken along line C—C of FIG. 2.

As particularly shown in FIG. 5 by reducing the peak height at the downward end of the refractory layer the profile of the triangular projection 10*a* is provided with a positive taper and a gradient of $\delta_1/l_1$, where $\delta_1$ is the peak height difference between the inlet side end and outlet side end of the triangular projection and $\delta_1$ is the length of the triangular projection. On the other hand, the height of the side edge portion 9 of the wall body 8 is inclined to gradually increase toward the downstream end. The gradient of the side edge portion can be illustrated as $\delta_2/l_2$, where $\delta_2$ is a height difference of the side edge portion 9 at the inlet side end and the outlet side end, and $\delta_2$ is the overall length of the side wall.

Because the metallic wall body 8 is cooled by coolant circulating in the coolant passage, heat exchange is performed between the side edge portions 9 exposed toward the casting chamber, and the melt for cooling the melt. By this, the solidified shell is grown on the side edge portion 9. During the continuous casting operation, the solidified shell is released from the surface of the exposed surfaces of the side walls 4 and 5 will never cause break outs or defects on the cast block because of the presence of the opposite taper of the refractory layer and the side edge portion 8*a*.

In order to demonstrate the performance of the belt caster employing the shown embodiment of the side walls according to the present invention, an experiment was performed for casting a low carbon aluminium killed steel cast block having thickness of 30 mm and width of 1200 mm. The casting speed was 12 m/min. The refractory layer 10 was formed of molten silica brick. The relevant dimensions $\delta_1$, $\delta_2$, $l_1$ and $\delta_2$ were as follows:

$\delta_1 = 35$ mm
$\delta_2 = 12$ mm
$l_1 = 65$ cm
$l_2 = 100$ cm

Under the condition set forth above, continuous casting for 600m per one heat was performed.

During the casting operation, operation was performed very smoothly without causing break outs or defects on the cast block.

Figure 6:
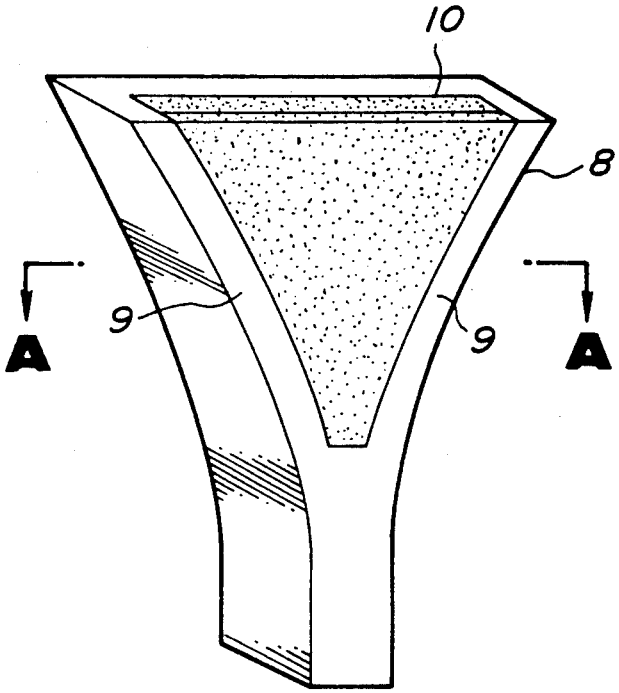
FIG. 6 is a perspective view of the second embodiment of a side wall construction to be employed in the belt caster of FIG. 1.
Figure 7:
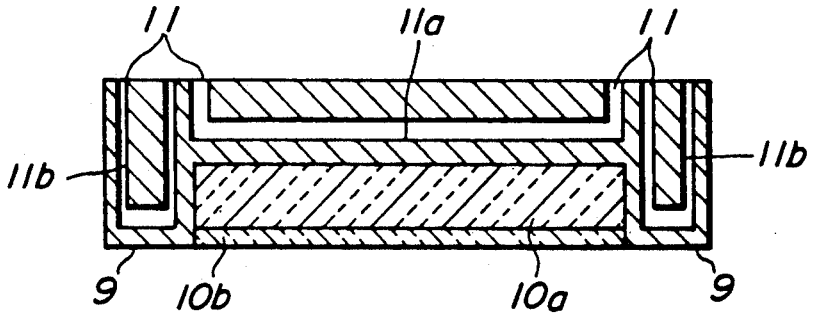
FIG. 7 is a section taken along line D—D of FIG. 6.

An alternative embodiment is shown in FIGS. 6 and 7, the refractory layer 10 supported in the metallic wall body 8 comprises a heat insulative refractory layer 10*b* and a wear-resistantive refractory layer 10*c*. In the shown embodiment, as shown in FIG. 7, the coolant passage 11*a* extending through the major section of the metallic wall body 8, and the coolant passage 11*b* extending through the side edge sections 9 of the wall body are formed for respectively associated section of the wall body. As can be seen from FIGS. 6 and 7, the heat insulative refractory layer 10*b* is oriented inside and the wear-resistantive refractory layer 10*c* is provided outside exposed to the casting chamber. In addition, a heat insulative layer 10*b* is at least partially formed on the surface of the wear-resistantive layer 10*c*. As can be seen from FIG. 8, the heat insulative layer 10*b* is formed in a area starting immediately below the meniscus line M and terminated at the portion where the constant transverse section starts.

Preferably, the heat insulative refractory layer 10*b* is selected among materials having heat transfer rates lower than or equal to 0.002 cal/cm.s.° C. for example, MgO board, $SiO_2$, type board, molten silica brick may be selected for forming the heat insulative refractory layer. On the other hand, the material for forming the heat insulative layer 10*b* is selected from among asbestos wool, glass fiber fabrics, rock wools and so forth, for example. The preferred thickness of the heat insulative layer 10*b* to be formed on the wear-resistantive refractory layer 10*c* is in a range of 1 mm to 3 mm. When the thickness of the heat insulative layer 10*b* is less than 1 mm, heat insulation becomes insufficient. On the other hand, if the thickness of the heat insulative layer 10*b* becomes thicker than 3 mm, the amount of slag to be created by melting becomes substantial. Furthermore, the material of the wear-resistantive refractory layer is required to have high spalling resistance and mechanical strength. In this respect, the shore hardness of the cast block immediately after withdrawal from the casting chamber is less than or equal to 10. Therefore, the wear-resistantive refractory layer must have a shore hardness greater than or equal to 10. Preferably, as the material for the wear-resistantive refractory layer is selected to have a shore hardness greater than or equal to 15 at a temperature of 1200° C. As materials satisfying such condition, silicon nitride, sialon, alumina, mullite, zirconium boride or composition of the above-mentioned material and boron-nitride may be advantageously selected.

In the preferred construction, the thickness of the wear-resistantive refractory layer 10*c* is in a range of 2 mm to 10 mm. If the thickness of the wear-resistantive refractory layer is less than 2 mm, it becomes easy to cause breakage to make handling a difficult. Furthermore, such a thin layer may not have satisfactory resistance against heat shock to cause breakage when it is subjected to heat shock. On the other hand, in case the thickness of the wear-resistantive refractory layer 10*c* is thicker than 10 mm, heat absorption at the initial stage of casting becomes substantial to cause formation of solidified shell thereon.

In order to demonstrate the performance of the belt caster employing the shown embodiment of the side walls according to the present invention, an experiment was performed for casting a low carbon aluminium killed steel cast block having thickness of 25 mm and width of 1350 mm. The casting speed was 12 m/min. The metallic wall body 8 was formed of Cu material containing Ag. The heat insulative refractory layer 10b was formed of Mgo board of thickness of 15 mm. On the other hand, the wear-resistantive refractory layer 10c was formed on sialon containing 20% of BN was used. The properties of these refractory layers are shown in the following table:

TABLE

| Refractory Layer (Material) | Thermal Conductivity (Kcal/m h °C.) | Linear Expansion Coefficient (cm/°C.) | High Temp. Hardness (1200° C.) |
|---|---|---|---|
| MgO Board | 0.2 | $10.8 \times 10^{-6}$ | Hs = 15 to 20 |
| Sialon-BN | 8.6 | $2.4 \times 10^{-6}$ | HS = 25 to 30 |

Figure 9:
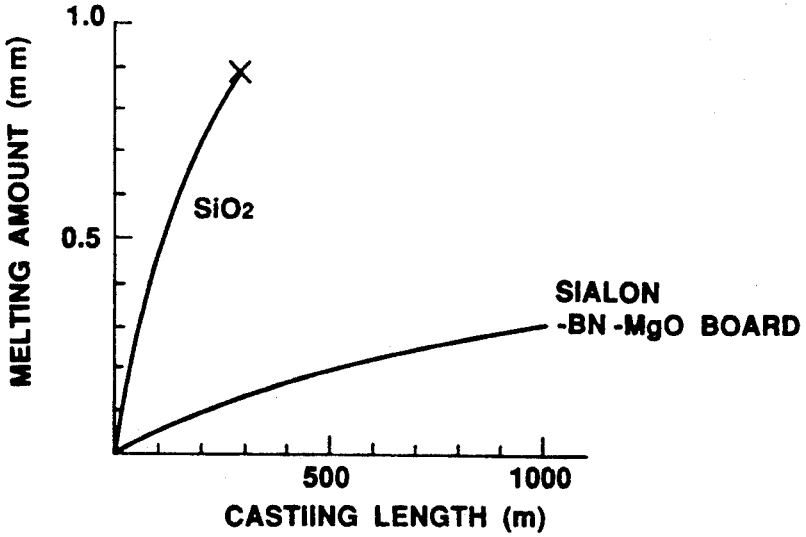
FIG. 9 is a graph showing the relationship with the amount of refractory being molten, in relation to the length of the caster.

In order to compare with the example set forth above, comparative examples were prepared with a single layer refractory formed of sialon-BN and $SiO_2$ type material. Results of experimental casting utilizing the preferred embodiment of the side wall and the comparative example are shown in FIG. 9.

In the case of the $SiO_2$ single layer refractory, thickness of melting out of the refractory became approximately 1 mm for casting length of 300mm. In this comparative example, break out was observed. On the other hand, in the case of a sialon-BN single layer refractory, the force required for withdrawing the cast block was increased at the initial stage of casting. After casting a length of 6m, break out was observed. In contrast to these, casting was smoothly performed without causing melting of the refractory when the preferred embodiment of the side wall set forth above was used.

Figure 8:
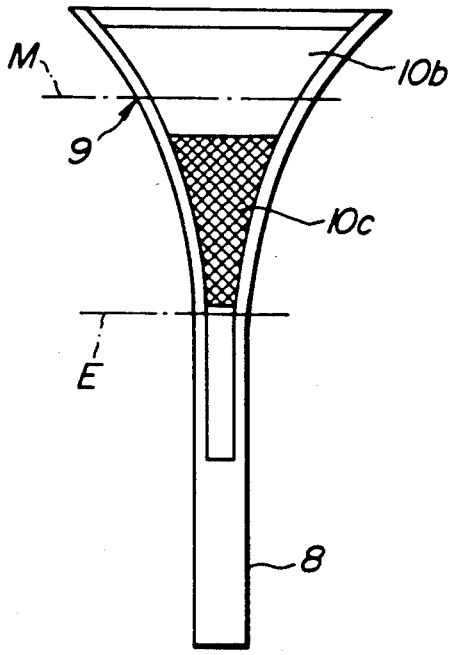
FIG. 8 is an explanatory front elevation of the side wall of FIG. 6.
Figure 10:
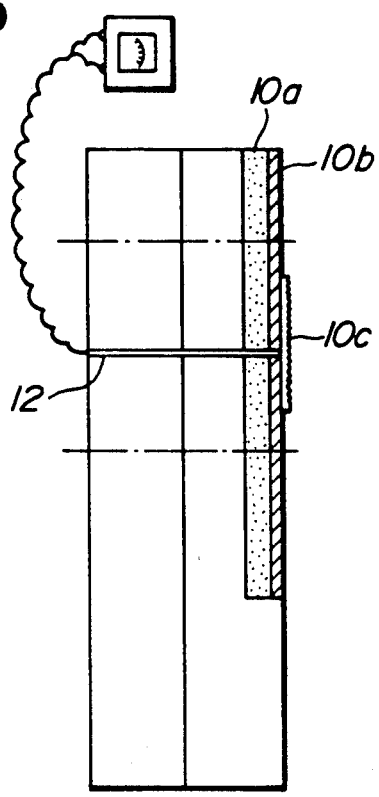
FIG. 10 shows an arrangement used for experiments.
Figure 11:
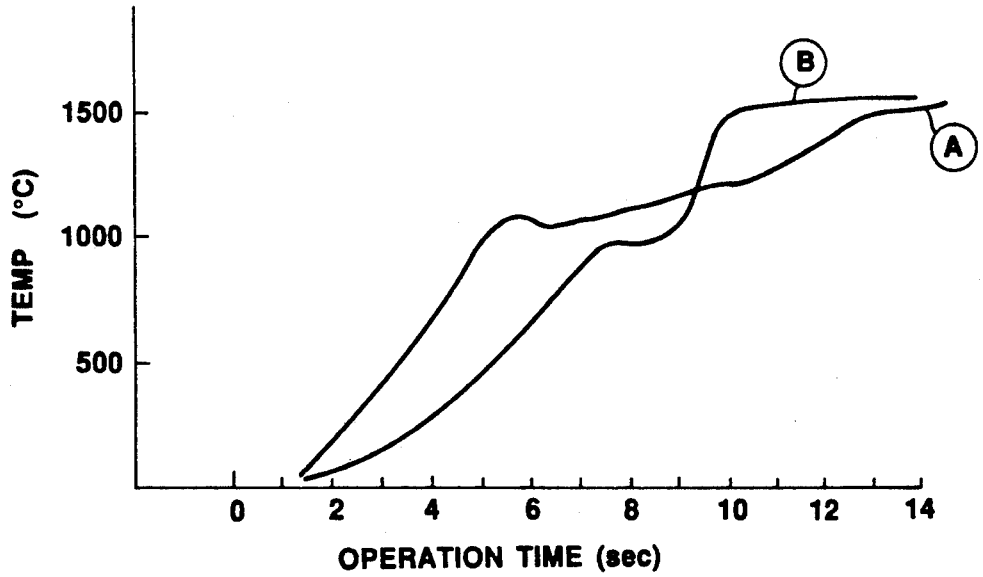
FIG. 11 is a graph showing variation of wall surface temperature depending upon the period of casting operation.

An additional experiment was performed by attaching asbestos fabric of 2.0 mm thick on the wear-resistantive layer in a manner shown in FIG. 8. An experiment was performed for casting a low carbon aluminum killed steel cast block having thickness of 25 mm and width of 1350 mm. The casting speed was 12 m/min. The temperature of the melt supplied to the casting chamber was 1,568° C. Temperature of the wear-resistantive refractory layer was measured by means of a thermocouple 12 embedded at a position of 1.5 mm from the surface, as shown in FIG. 10. Measured temperature by the thermocouple 12 is shown in FIG. 11. In FIG. 11, the line A shows the temperature variation in the wear-resistantive refractory layer when asbestos the layer was not attached and the line B shows the temperature variation in the wear-resistantive refractory layer as coupled with the asbestos layer. As can be seen from FIG. 11, the temperatures in both case becomes substantially equal to each other after 14 sec. of starting the casting operation. In the case that the asbestos layer is provided, by the heat insulative effect of the asbestos layer, a solidified shell was not formed even at the low temperature period, i.e. approximately 9 sec. of starting the casting operation. In contrast, in the case that the asbestos layer was not provided, slight solidification was observed in a period until 5 sec. after start casting.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

For example, though the shown embodiments are concentrated to the belt caster, the present invention will be applicable of any type of continuous caster which employs a side wall with a refractory layer.

What is claimed is:

1. A side wall structure of a continuous caster which has a pair of endless circulating bodies forming moving walls of the caster and a pair of side walls forming stationary walls of said caster, said stationary walls being cooperative with said moving walls for defining a casting chamber to which a molten metal is supplied for casting a continuous cast block, said side wall comprising:

a metallic wall body formed of a metal;

a refractory layer provided on the transverse central portion of said metallic wall body having a surface portion interfacing with molten metal for preventing the latter from solidying thereon, said refractory layer being formed with an essentially triangular projection extending into said casting chamber and positioned substantially centrally with respect thereto, said triangular projection having a substantially rounded apex portion; and metallic side edge members integrally formed with said metallic wall body and extending along both transverse edges of said refractory layer to expose surfaces thereof.

2. a side wall structure as set forth in claim 1, wherein said triangular projection is provided with a taper in an axial direction of said casting chamber and said side edge members are also provided with a taper in the axial direction of said casting chamber, the tapers of said triangular projection and said edge members being opposite to each other.

3. A side wall structure as set forth in claim 2, wherein said triangular projection decreases in height in the downstream direction.

4. A side wall structure as set forth in claim 1, wherein said refractory layer comprises an inner heat insulative refractory layer and an outer wear-resistive refractory layer which has a surface exposed to said casting chamber.

5. A side wall structure as set forth in claim 4, which further comprises a heat insulative layer formed on the surface of said wear-resistive refractory layer.

6. A side wall structure as set forth in claim 5, wherein said heat insulative layer is provided in a region below a meniscus of the molten metal.

7. A side wall structure as set forth in claim 4, wherein said wear-resistive refractory layer is formed of a material having a Shore hardness at a predetermined high temperature range greater than a shore hardness of cast block immediately after casting.

8. A side wall structure as set forth in claim 7, wherein the material of wear-resistive refractory layer is selected to have 15 of Shore hardness at 1200° C.

9. A side wall structure as set forth in claim 4, wherein said wear-resistive refractory layer is selected from the group consisting of silicon nitride, sialon, alumina, mullite and zirconium boride and a mixture of silicon nitride, sialon, alumina, mullite or zirconium with boron nitride.

10. A side wall structure as set forth in claim 4, wherein said heat insulative refractory layer is selected from the group consisting of $M_gO$ board, $SiO_2$ type board and molten silica brick.

11. A side wall structure as set forth in claim 5, wherein hear insulative layer is selected from the group consisting of asbestos fabric, glass fiber fabric or rock wool.

12. A side wall structure as set forth in claim 5, wherein said wear-resistive refractory layer is selected from the group consisting of silicon nitride, sialon, alumina, mullite and zirconium boride and a mixture of silicon nitride, sialon, alumina, mullite, zirconium boride with boron nitride.

13. A side wall structure of a continuous caster which has a pair of endless circulating bodies forming moving walls of the caster and a pair of side walls forming stationary walls of said caster, said stationary walls being cooperative with said moving walls for defining a casting chamber to which a molten metal is supplied for casting a continuous cast block, said side wall comprising:

a metallic wall body formed of a metal;

a refractory layer provided on the transverse central portion of said metallic wall body having a surface portion interfacing with molten metal for preventing the latter from solidifying thereon, which solidification preventive surface portion comprises an essentially triangular projection extending at the transverse center and projecting into said casting chamber, said projection having a contour with a substantially rounded apex portion and which extends along the feed direction of the cast block and reduces in height in the downward direction;

metallic side edge members integrally formed with said metallic wall body and extending along both transverse edges of said refractory layer to expose surfaces thereof.

14. A side wall structure as set forth in claim 13 wherein said triangular projection is provided with a taper in an axial direction of said casting chamber and said side edge members are also provided with a taper in the axial direction of said casting chamber, the tapers of said triangular projection and said side edge members being opposite to each other.

15. A side wall structure as set forth in claim 14, wherein said triangular projection decreases in height in the downstream direction.

16. A side wall structure of a continuous caster which has a pair of endless circulating bodies forming moving walls of the caster and a pair of side walls forming stationary walls of said caster, said stationary walls being cooperative with said moving walls for defining a casting chamber having an inlet and an outlet into which molten metal is supplied for casting a continuous cast block, said side wall comprising:

a metallic wall body formed of a metal;

a refractory layer provided on the transverse central portion of said metallic wall body having a surface portion exposed to said casting chamber, said surface portion having a substantially triangular cross-section with an apex extending into the casting chamber and positioned substantially centrally with respect thereto and being tapered and decreasing in height from the inlet to the outlet, said refractory layer comprising an inner heat insulative refractory layer and an outer wear-resistive refractory layer which has said surface exposed to said casting chamber; and metallic side edge members integrally formed with said metallic wall body and extending along both transverse edges of said refractory layer to expose surfaces thereof, said side edge members tapering in the axial direction of the casting chamber and decreasing in height from the inlet to the outlet.

17. A side wall structure as set forth in claim 16, which further comprises a heat insulative layer formed on the surface of said wear-resistive refractory layer.

18. A side wall structure as set forth in claim 17, wherein said heat insulative layer is provided in a region below a meniscus of the molten metal.

19. A side wall structure as set forth in claim 16, wherein said wear-resistive refractory layer is formed of a material having Shore hardness at a predetermined high temperature range greater than a Shore hardness of cast block immediately after casting.

20. A side wall structure as set forth in claim 19, wherein the material of wear-resistive refractory layer is selected to have 15 of Shore hardness at 1200° C.

21. A side wall structure as set forth in claim 16, wherein said heat insulative refractory layer is selected from the group consisting of $M_gO$ board, $SiO_2$ type board and molten silica brick.

22. A side wall structure as set forth in claim 17, wherein said heat insulative layer is selected from the group consisting of asbestos fabric, glass fiber fabric and rock wool.

* * * * *

UNITED STATES PATENT AND TRADEMARK OFFICE

CERTIFICATE OF CORRECTION

PATENT NO. : 5,127,462

DATED : July 7, 1992

INVENTOR(S) : Saburo Moriwaki et al

It is certified that error appears in the above-identified patent and that said Letters Patent is hereby corrected as shown below:

Column 5, line 37, please change "$\delta_1$" to --$l_1$--;

line 44, please change "$\delta_2$" to --$l_2$--; and line 63, please change "$\delta_2$", second occurrence, to --$l_2$--.

This certificate supersedes Certificate of Correction issued July 27, 1993.

Signed and Sealed this

Ninth Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,127,462

DATED : July 7, 1992

INVENTOR(S) : Saburo Moriwaki et al

It is certified that error appears in the above-identified patent and that said Letters Patent is hereby corrected as shown below:

On the Title Page, Item [73], after "Kawasaki Steel Corporation, Japan", please insert --Kawasaki Refractories Co., Ltd., Japan-- and --Hitachi Ltd., Japan--.

Signed and Sealed this

Nineteenth Day of April, 1994

Bruce Lehman

BRUCE LEHMAN

*Commissioner of Patents and Trademarks*

*Attest:*

*Attesting Officer*